United States Patent [19]

Asphahani et al.

[11] Patent Number: 4,489,040

[45] Date of Patent: Dec. 18, 1984

[54] CORROSION RESISTANT NICKEL-IRON ALLOY

[75] Inventors: Aziz I. Asphahani; Eugene W. Kelley; Juri Kolts, all of Kokomo, Ind.

[73] Assignee: Cabot Corporation, Kokomo, Ind.

[21] Appl. No.: 364,954

[22] Filed: Apr. 2, 1982

[51] Int. Cl.[3] ..... C22C 30/00

[52] U.S. Cl. ..... 420/584; 148/442; 420/582; 420/585; 420/586

[58] Field of Search ..... 420/582, 584, 585, 586; 148/442

[56] References Cited

U.S. PATENT DOCUMENTS 2,432,616 12/1947 Franks et al. ..... 420/584

*Primary Examiner*—R. Dean

*Attorney, Agent, or Firm*—Jack Schuman; Joseph J. Phillips

[57] ABSTRACT

Disclosed is an alloy eminently suited for use as a tubular product in deep, sour gas operations. The alloy has an optimum combination of corrosion resistance, high strength in the cold worked condition and resistance to sulfide stress cracking and stress corrosion cracking. A typical alloy contains, in weight percent, 0.03 carbon, 22 chromium, 36 iron, 3 molybdenum, 1 manganese, 36 nickel, 0.60 silicon, 0.15 nitrogen, up to 3 tungsten and incidental impurities including copper, cobalt, columbium, tantalum and titanium.

10 Claims, No Drawings

CORROSION RESISTANT NICKEL-IRON ALLOY

This invention relates to corrosion resistant alloys containing a base of nickel, iron and chromium with essential modifiers. The alloy of this invention is especially suited for use in deep sour gas wells in the form of tubular products.

BACKGROUND

Highly alloyed stainless steels and nickel-base alloys are finding wide usage as tubular products in deep, high-pressure, sour gas well applications. The environments in each application will vary but the range of conditions where alloy tubulars are utilized in the oil and gas industry may contain pressures between 15,000–20,000 psi and temperatures up to 450° F. with $H_2S$ contents ranging between 50 ppm to 40%. Most deep gas wells will contain water with high salt contents which further increase the agressiveness of the environment.

A high degree of corrosion resistance is required for alloys in deep, sour gas applications. As the temperatures, pressures, and $H_2S$ contents, and possibly $CO_2$ contents, in gas well environments increase, the severity of corrosion increases. Carbon and low alloy steels can no longer be utilized successfully because of their high corrosion rates. Corrosion inhibitors may not provide adequate protection in these wells. In some cases, the environment temperatures exceed the effective inhibitor temperature range. In other wells, the dynamic flow conditions do not permit proper maintenance of the inhibitor films. Finally, corrosion inhibitor utilization requires, in many cases, the construction of additional off shore platform space and continuing manpower requirements, making alloy tubular goods a more economical choice for combating corrosion.

In these highly aggressive environments, the tubular alloys need to possess high strength. The increased strength is required, both (1) to contain the higher pressures encountered in the service and (2) to support the weight of the longer string of tubing. In order to achieve these strength levels, alloy tubulars are usually cold worked, for example, by pilgering, cold drawing, or other suitable methods. Although each application will have its particular specification, the mechanical properties required for tubulars in deep gas wells may range from a yield strength of 110,000 psi to 180,000 psi.

PRIOR ART ALLOYS

A high resistance to sulfide stress cracking (SSC) and stress corrosion cracking (SCC) is required for tubular products in deep, sour gas applications. Stainless steels such as type 304 or 316 do not possess sufficient chloride stress corrosion cracking resistance. Duplex stainless steels such as described in U.S. Pat. No. 3,567,434 and marketed under the registered trademark FERRALIUM alloy 255 are suitable for the milder environments, but they do not provide adequate SCC resistance for the severe, high $H_2S$-containing environments. Nickel-base alloys such as HASTELLOY ® alloy G-3 or HASTELLOY ® alloy C-276 possess the required SSC and SCC resistance. There is an urgent need for new alloys with properties comparable to alloy G-3 or alloy C-276, but with a lower cost.

Alloy 20 is a commercial alloy known to possess good corrosion resistance in deep, sour gas environments. Alloy SS28 is another example of a commercially available alloy in this class.

U.S. Pat. No. 3,203,792 discloses alloy C-276 and U.S. Pat. No. 2,955,934 and 3,366,473 discloses similar alloys of this class.

Table 1 lists the nominal compositions of these prior art alloys. There are several drawbacks that restrict the maximum use of these alloys for service as tubulars in deep, sour gas wells. Some alloys do not have the required combination of mechanical and physical properties together with adequate corrosion resistance. Some alloys have all the required characteristics but are expensive because of the high contents of nickel, molybdenum and others.

OBJECTS OF THE INVENTION

It is the principal object of this invention to provide an alloy with the required combination of properties for use as deep, sour gas well components.

It is another object of this invention to provide an alloy for deep sour gas service at low costs.

It is still another object of this invention to provide deep sour gas components in the form of cold-reduced tubulars.

These, and other objects and benefits apparent to those skilled in the art, are provided by the alloy of this invention.

SUMMARY OF THE INVENTION

This invention provides a new alloy which possesses a combination of all of the requirements discussed in the previous paragraphs. It possesses excellent corrosion resistance, stress corrosion cracking resistance, and resistance to sulfide stress cracking. With its carefully selected chemical composition, this new alloy can be processed to high strength levels without adversely affecting the SCC and SSC properties. Also, the alloy should compete favorably on an economic basis with alloys such as alloy G-3 and alloy C-276 which possess the required properties for deep, sour gas service.

Composition of the alloy of this invention is presented in Table 2. All compositions in this specification and claims are given in percent by weight, unless otherwise stated.

The iron together with impurities is shown as balance, however, nickel and iron must be present in the alloy of this invention in substantially equal parts. Iron must be present within the range 0.8 to 1.2 of the nickel content (Fe:Ni=0.8 to 1.2:1).

Chromium is present in the alloy principally to provide the corrosion resistance and stable passivity in severe sour gas environments.

Molybdenum is present principally to provide pitting resistance in severely aggressive environments. Tungsten may also be present with molybdenum up to the limits listed in Table 2. Excessive molybdenum and tungsten contents may impare workability. Tungsten enhances the sulifide stress corrosion resistance and may provide additional carbide strengthening to the structure of the alloy. Tungsten should not replace molybdenum. Molybdenum must always be present within the range given in Table 2.

Nitrogen is a critical element in the alloy of this invention. Less than 0.03% nitrogen is not adequate to provide the benefits but over about 0.35% nitrogen is not recommended. Excess nitrogen may contribute to embrittlement of the alloy and reduced ductility.

TESTING AND TEST RESULTS

A series of experimental alloys were melted as described in Table 3.

In the production of castings, powder, etc. the optional elements and impurities may be present within the ranges given in Table 2. However, for wrought product, these elements (especially titanium) must be kept as low as possible for optimum results.

The alloys of this invention may be melted and processed readily by methods well known in the art, such as air arc melting, air induction melting, vacuum arc remelting (VAR), electro-slag remelting (ESR) and the like.

Samples of the alloys were processed into seamless tubing by pilgering and were tested in the as-cold worked condition. The last pilgering operation of the processing series imparts the cold work into the tubing. The degree of cold work (percent reduction in area) controls the level of the mechanical properties with increasing cold work resulting in correspondingly increasing yield and tensile strengths. However, each alloy composition possesses an upper limit in which increasing amounts of cold work only marginally increase the yield and tensile strengths. This occurs at reductions in the area between 40 and 70%. In addition, reductions in areas much higher than 60% are not employed in most production practices. From a standpoint of attaining and controlling the mechanical properties of cold worked tubing, it is desirable to obtain the desired level of properties with reductions in the range of 25 to 60%. Much lower reductions in pilgering result in non-uniform deformation and much higher reductions may result in excessive breakage during processing due to lowered ductility.

Table 4 provides the mechanical properties of the pilgered tubing processes from the alloy of this invention with varying nitrogen levels. The alloy with the nitrogen content of 0.118 provides yield strengths in the range of 120 to 140 Ksi, while the alloys with the lower nitrogen contents do not reach the 120 Ksi yield range for comparable final cold working reductions. For many applications it is necessary to have yield strengths above 120 or over 140 Ksi in deep, sour gas tubular products.

Table 5 provides the tensile results for wrought products as a function of cold working. The tests were made on cold rolled bar. Table 5 shows hardness in Rockwell C. Rockwell C readings are not usually reported much below Rockwell C-20. The table presents values converted from Rockwell B measurements in order to provide a single scale of hardness for direct comparison.

The data shown in Tables 4 and 5 show that the nitrogen content of the alloy of this invention is very critical. Alloys 1, 2 and 4 (containing 0.118%, 0.053% and 0.228% nitrogen, respectively) have the best combination of properties and cold working characteristics. Alloy 3 (containing 0.018% nitrogen) is not suitable and is not an alloy of this invention.

Corrosion resistance in a variety of media is required in alloys of this class. Two samples of Alloy No. 1 were tested together with Alloy 20 which is used in the art. Alloy 1 samples were cold-worked at 31% reduction and 48% reduction. Alloy 20 was cold-worked to 59% reduction as required to obtain maximum strength.

Data obtained in the corrosion test are presented in Table 6. Significantly, the data show that it is not necessary to cold work up to 59% reduction to obtain maximum properties in the alloy of this invention. These data further show (1) the corrosion resistance of the alloy of this invention exceeds that of alloy 20 in every test; and (2) cold-working within this range is desirable; and (3) the degree of cold-working between 31% and 48% is not particularly significant in corrosion resistance.

A series of tests were completed to determine the resistance to sulfide stress cracking (SSC) and stress corrosion cracking (SCC). Two samples of Alloy 1 which were cold-worked 31% and 48% were tested together with Alloy 20 and Alloy G-3.

Both sulfide stress cracking and stress corrosion cracking resistance are required for these alloys. Sulfide stress cracking resistance in nickel-base alloy systems is measured by resistance to cracking in the NACE environment as described by the NACE test method TM-01-77. For nickel-base alloys, the test is made more severe by coupling the alloy to carbon steel. Low temperature aging (for example at 204° C. for 200 Hrs.) makes this test even more severe. Even in the most severe condition (steel couple+low temperature aging), the alloy of this invention resists sulfide stress cracking when stressed as C-rings to 95% of its yield strength. Data in Table 7 demonstrates this behavior.

Stress corrosion cracking often occurs at elevated temperatures and is aggravated by increasing chloride contents, reduced pH, and increasing $H_2S$ content. Alloy No. 20 is often used because of its increased SCC resistance to replace T304 or 316 stainless steels when these fail by SCC in service. Table 7 compares the SCC resistance of Alloy No. 20 and Alloy G with Alloy 1 of this invention. Laboratory environments more severe than most field environments were chosen so that alloy comparisons could be made. The tests reported in columns 3 and 4 were performed on C-ring samples stressed to 75 and 95 percent of the yield strength of the respective alloys. The aqueous solution and test specimens were placed into autoclaves. The autoclaves were sealed and pressurized with the specified gases ($H_2S$ or 90% $CO_2$+10% $H_2S$ or others) to 75 psi. The autoclaves were then heated to the specified temperatures. On predetermined periods, the autoclaves were cooled and opened, and the specimens were examined. Thus the times to initiate cracking were determined. As can be seen, the stress cracking performance of Alloy 1 is better than Alloy No. 20 but not as good as Alloy G-3. This behavior can be attributed to the nickel content of the alloys. Alloy No. 20 contains nominally 26% nickel while Alloy 1 contains 36% nickel. Alloy G-3 contains about 47% nickel.

It appears, therefore, that the nominal nickel content at 36% and the iron content also about 36%, yields the optimum balance of good engineering properties and cold working characteristics in view of costs. For this reason, the relationship between nickel and iron contents must be kept within the range 0.8 to 1.2.

Alloy 5, an alloy of this invention, was prepared to represent essentially the typical alloy shown in Table 2. The alloy contained, in weight percent, 0.02 carbon, 22.18 chromium, 35.45 iron, 0.98 manganese, 3.0 molybdenum, 0.150 nitrogen, 36.84 nickel, 0.56 silicon and the balance impurities normally found in alloys of this class. The alloy was cold worked to 43% reduction yielding tubes 2.875 inches O.D. by 0.276 inch wall thickness. One tensile bar specimen from each of 32 tubes of Alloy 5 was machined and tested. The 32 tests averaged 147.2 KSI ultimate tensile strength, 133.6 KSI at 0.2% yield strength and 19.9% elongation. These average data fully meet the objectives and requirements as stated earlier. Alloy 5 is representative of the optimum alloy composition for use in deep, sour gas wells as described hereinbefore.

Although the exact mechanism of the science of this invention is not completely understood, there appears to be a synergistic effect between the iron-nickel ratio and critical contents of principal elements molybdenum, nitrogen and chromium to provide the valuable characteristics of the alloy of this invention.

The alloy of this invention may be produced by any process now used in the manufacture of superalloys of this class, for example, Alloy C-276. The alloy may be produced in the form of powder for known powder metallurgy processing. The alloy has been readily welded and may be used as articles for welding: i.e., weld rod, welding wire etc. The hot and cold working properties of this alloy permit the production of hot and cold rolled thin sheet, tubing and other commercial forms.

In the foregoing specification there has been set out certain preferred embodiments of this invention, however, it will be understood that this invention, may be otherwise embodied within the scope of the following claims.

TABLE 1

| Alloy No. | Prior Art Alloys Nominal Composition, weight percent | | | | | | |
|---|---|---|---|---|---|---|---|
| | 304LN | 316LN | 255 | G3 | C-276 | 20 | 28 |
| C | .03* | .03* | 0.04* | .015* | .02* | .05* | .02* |
| Cr | 18 | 16 | 26 | 22 | 15.5 | 22 | 27 |
| Fe | Bal | Bal | Bal | 19.5 | 5.5 | Bal | Bal |
| Mo | — | 2.5 | 3 | 7 | 16 | 5 | 3.5 |
| Mn | 2* | 2* | .8 | .8 | 1* | 2.5* | 2* |
| Ni | 8 | 10 | 5.5 | Bal | Bal | 26 | 31 |
| Si | 1* | 1* | .45 | .4 | .08* | 1* | 1* |
| W | — | — | — | 1.5* | 3.75 | — | — |
| N | .12 | .20 | 0.17 | — | — | — | — |
| Cu | — | — | 1.7 | 1.9 | — | — | 1.0 |
| Co | — | — | — | 5* | 2.5* | — | 1.0 |
| Cb + Ta | — | — | — | .3 | — | — | — |
| Ti | — | — | — | — | — | 4 × C min. | — |

*Indicates Maximum

TABLE 2

| | Alloys Of this Invention Composition, weight percent | | |
|---|---|---|---|
| | Broad Range | Preferred Range | Typical Alloy |
| C | .06 max | .005–.05 | .03 |
| Cr | 20–24 | 21–23 | about 22 |
| Fe | Bal | Bal | about 36 |
| Mo | 2–4.5 | 2–4 | about 3.0 |

TABLE 2-continued

| | Alloys Of this Invention Composition, weight percent | | |
|---|---|---|---|
| | Broad Range | Preferred Range | Typical Alloy |
| Mn | .5–2.5 | .5–1.5 | about 1 |
| Ni | 34–38 | 34–38 | about 36 |
| Si | up to 1 | .25–1 | about .60 |
| W | 0–3.5 | 0–3.5 | up to 2.5 |
| N | .03–.35 | .10–.20 | about .15 |
| Cu | .75 max | .50 max | .50 max |
| Co | 4 max | 3 max | 3 max |
| Cb + Ta | up to 1 | up to 1 | 1 max |
| Ti | .25 max | .2 max | .05 max |
| Fe:Ni | .8 to 1.2:1 | .8 to 1.2:1 | about 1:1 |

TABLE 3

| | Experiment Alloys Composition, in weight percent Alloy No. | | | |
|---|---|---|---|---|
| | 1* | 2* | 3* | 4* |
| C | .016 | .02 | .031 | .04 |
| Cr | 21.9 | 21.7 | 22.7 | 22.7 |
| Fe | Bal about 36 | Bal about 36 | Bal about 36 | Bal about 36 |
| Mo | 3.11 | 2.94 | 3.43 | 2.97 |
| Mn | .92 | .94 | .85 | .84 |
| Ni | 36.2 | 36.6 | 34.0 | 37.0 |
| Si | .57 | .61 | .37 | .41 |
| W | .16 | .06 | — | .11 |
| N | .118 | .053 | .018 | .228 |

*Alloys of this Invention

TABLE 4

| ALLOY | Mechanical Properties and Nitrogen Contents | | | |
|---|---|---|---|---|
| | Nitrogen Content (%) | Cold Work (%) | Yield Strength (ksi) | Tensile Strength (ksi) |
| 1* | 0.118 | 31 | 119 | 133 |
| | | 48 | 142 | 151 |
| 2* | 0.053 | 46.3 | 117 | 131 |
| | | 59 | 114 | 137 |
| 3 | 0.018 | 43 | 119 | 125 |
| 4* | .228 | 31 | 135 | 151 |

*ALLOYS OF THIS INVENTION

TABLE 5

| Hardness and Tensile Strength vs. Percent Cold Reduction | | | | | | | | |
|---|---|---|---|---|---|---|---|---|
| Alloy 1 (0.118% N) | | | Alloy 2 (0.053% N) | | | Alloy 3 (0.018% N) | | |
| Cold Work (%) | Hardness ($R_c$) | Ultimate (ksi) | Cold Work (%) | Hardness ($R_c$) | Ultimate (ksi) | Cold Work (%) | Hardness ($R_c$) | Ultimate (ksi) |
| 0 | 3.0 | 95.9 | 0 | 7.1 | 87.0 | 0 | 5.3 | 82.8 |
| 7.8 | 13.4 | 106.0 | 9.8 | 14.4 | 98.6 | 8.7 | 11.4 | 93.4 |
| 17.1 | 21.7 | 120.7 | 20.0 | 23.0 | 114.5 | 19.1 | 20.8 | 107.1 |
| 28.6 | 29.3 | 139.3 | 31.5 | 28.0 | 133.3 | 31.2 | 25.6 | 127.6 |
| 38.2 | 30.1 | 148.7 | 40.5 | 30.3 | 142.3 | 40.7 | 28.9 | 138.4 |
| 49.1 | 32.4 | 158.9 | 51.1 | 31.9 | 152.7 | 50.5 | 30.8 | 146.1 |
| 59.0 | 36.5 | 163.7 | 60.0 | 34.4 | 162.7 | 60.3 | 32.8 | 159.3 |

TABLE 6

| Alloy | Corrosion Resistance of Selected Alloys Corrosion Rate, (mpy) | | | |
|---|---|---|---|---|
| | Cold Worked | 85% $H_3PO_4$ Boiling | 10% $H_2SO_4$ Boiling | 10% $H_2SO_4$ + $Fe_2(SO_4)3$ Boiling |
| 20 | 59% | 710 | 86, 86 | 12.0 |
| 1 | 31% | 180, 220 | 41, 42 | 8.4 |
| 1 | 48% | 200, 200 | 44, 45 | 8.4 |

*(mpy) mils per year

TABLE 7

| Alloy | Cold Worked | Yield Strength (ksi) | SSC and SCC Performance of Selected Alloys Time to Failure, Hours: NACE Solution Steel Bolt Room Temperature | 25% NaCl + 0.5 HAc + $H_2S$ + 1 g/l S 177° C. | 25% NaCl + 90% $CO_2$ + 10% $H_2S$ 200° C. |
|---|---|---|---|---|---|
| 20 | 59% | 131 | NF* | 48, 48 | 48, 48 |
| 1 | 31% | 119 | NF | 168, 168 | NF |
| 1 | 48% | 142 | NF | 96, 168 | 48, NF |
| G-3 | 59% | 150 | NF | — | NF, NF |

*NF denotes No Failure

What is claimed is:

1. An alloy suitable for use in deep sour gas wells consisting essentially of, in weight percent, 0.001 to 0.06 carbon, 20 to 24 chromium, 2 to 4.5 molybdenum, up to 2.5 manganese, 34 to 38 nickel, up to 1 silicon, up to 3.5 tungsten, 0.03 to 0.35 nitrogen, up to 0.75 copper, up to 4 cobalt, up to 1 columbium plus tantalum, up to 0.25 titanium and the balance iron and incidental impurities, provided that the iron-to-nickel ratio is between 0.8 and 1.2 to 1 to provide the combined characteristics of corrosion resistance, high strength in the cold-worked condition and resistance to sulfide stress cracking and stress corrosion cracking.

2. The alloy of claim 1 wherein the carbon is 0.005 to 0.05, the chromium is 21 to 23, the molybdenum is 2 to 4, the manganese is 0.5 to 1.5, the silicon is 0.25 to 1, the nitrogen is 0.10 to 0.20, the copper is up to 0.5, the cobalt is up to 3, and the titanium is up to 0.2.

3. The alloy of claim 1 containing about 0.03 carbon, about 22 chromium, about 3 molybdenum, about 1 manganese, about 36 nickel, about 0.6 silicon, about 0.15 nitrogen, wherein the ratio of Fe:Ni is about 1:1.

4. The alloy of claim 1 containing about 0.016 carbon, about 22.0 chromium, about 3.10 molybdenum, about 0.90 manganese, about 36 nickel, about 0.55 silicon and about 0.12 nitrogen.

5. The alloy of claim 1 containing about 0.02 carbon, about 22 chromium, about 2.9 molybdenum, about 0.9 manganese, about 36.5 nickel, about 0.6 silicon, and about 0.05 nitrogen.

6. The alloy of claim 1 containing about 0.04 carbon, 22 chromium, about 2.95 molybdenum, about 0.8 manganese, about 37 nickel, about 0.4 silicon, and about 0.228 nitrogen.

7. The alloy of claim 1 containing about 0.02 carbon, about 22 chromium, about 35.5 iron, about 1 manganese, about 3 molybdenum, about 0.15 nitrogen, about 36.8 nickel, about 0.56 silicon and the balance incidental impurities.

8. The alloy of claim 1 in the form of cold worked tubular product suitable for use in deep, sour gas well applications.

9. The alloy of claim 1 in the form of a casting, plate, thin sheet, tubing, metal powder or wire rod.

10. The alloy of claim 1 in the form of an article suitable for welding.

* * * * *